US007562744B2

(12) United States Patent
Mustalahti et al.

(10) Patent No.: US 7,562,744 B2
(45) Date of Patent: Jul. 21, 2009

(54) METHOD FOR INSTALLING AN ELEVATOR, AND ELEVATOR DELIVERY ASSEMBLY

(75) Inventors: Jorma Mustalahti, Hyvinkää (FI); Esko Aulanko, Kerava (FI)

(73) Assignee: Kone Corporation, Helsinki (FI)

( * ) Notice: Subject to any disclaimer, the term of this patent is extended or adjusted under 35 U.S.C. 154(b) by 0 days.

(21) Appl. No.: 11/505,976

(22) Filed: Aug. 18, 2006

(65) Prior Publication Data

US 2007/0017750 A1 Jan. 25, 2007

Related U.S. Application Data

(63) Continuation of application No. PCT/FI2005/000135, filed on Mar. 4, 2005.

(30) Foreign Application Priority Data

Mar. 18, 2004 (FI) ..... 20040421

(51) Int. Cl.
*B66B 11/08* (2006.01)
*B66B 11/02* (2006.01)
*B66B 7/02* (2006.01)

(52) U.S. Cl. ..... 187/254; 187/266; 187/401; 187/406; 187/414

(58) Field of Classification Search ..... 187/254, 187/266, 401, 900, 414, 406; 52/30; *B66B 19/00, B66B 7/00, 7/06*
See application file for complete search history.

(56) References Cited

U.S. PATENT DOCUMENTS 216,568 A * 6/1879 Holske ..... 187/251
3,851,736 A * 12/1974 Westlake et al. ..... 52/745.2
4,231,148 A 11/1980 Harding
4,345,671 A * 8/1982 Tosato et al. ..... 52/145.2
4,502,570 A * 3/1985 Westerlund ..... 187/264
5,000,292 A * 3/1991 Chapelain et al. ..... 187/408
6,446,763 B1 * 9/2002 Glassey et al. ..... 187/414
2002/0066622 A1 * 6/2002 Pettersson et al. ..... 187/414

FOREIGN PATENT DOCUMENTS

EP 0375208 6/1990

(Continued)

OTHER PUBLICATIONS

International Search Report (PCT/ISA/210) and (PCT/ISA/220).

(Continued)

*Primary Examiner*—Peter M Cuomo
*Assistant Examiner*—Stefan Kruer
(74) *Attorney, Agent, or Firm*—Harness, Dickey & Pierce, P.L.C.

(57) ABSTRACT

An elevator is provided comprising a number of diverting pulleys in the upper part of an elevator shaft or equivalent, a number of diverting pulleys in the lower part of the elevator shaft and a number of diverting pulleys on the elevator car. In various embodiments, at least some of the diverting pulleys are pre-rigged and brought into the elevator shaft together with the car, and the hoisting ropes are stretched to their proper length when the diverting pulleys in the upper and lower parts of the shaft are mounted in place. In various embodiments, the elevator may be an elevator without counterweight.

20 Claims, 6 Drawing Sheets

FOREIGN PATENT DOCUMENTS

| | | | | |
|---|---|---|---|---|
| EP | 0631968 | | | 9/1996 |
| EP | 1380532 | | | 1/2004 |
| EP | 0631967 | | | 9/2004 |
| FR | 2823734 | A1 | * | 10/2002 |
| JP | 2000247560 | A | * | 9/2000 |
| JP | 2003128359 | A | * | 5/2003 |
| WO | 98/06655 | | | 2/1998 |
| WO | 2004/041701 | | | 5/2004 |

OTHER PUBLICATIONS

"The Mystery in Munich". J. Gale. Elevator World, vol. 45, No. 7, Elevator World Inc., Jul. 1997, Birmingham, AL, US, pp. 59-68.

* cited by examiner

METHOD FOR INSTALLING AN ELEVATOR, AND ELEVATOR DELIVERY ASSEMBLY

CROSS-REFERENCE TO RELATED APPLICATIONS

This application is a continuation of PCT/FI2005/000135, filed on Mar. 4, 2005, which is an international application claiming priority from FI 20040421, filed Mar. 18, 2004, the entire contents of which are hereby incorporated by reference.

BACKGROUND

1. Field

The present invention relates to a method for installing an elevator, to an elevator installed by a method for installing an elevator, and to an elevator delivery assembly module.

2. Description of Related Art

One of the objectives in elevator development work is to achieve an efficient and economical utilization of building space. In recent years, this development work has produced various elevator solutions without machine room, among other things. Good examples of elevators without machine room are disclosed in specifications EP 0 631 967 (A1) and EP 0 631 968. The elevators according to these specifications are fairly efficient in respect of space utilization as they have made it possible to eliminate the space needed for the machine room in the building without a need to enlarge the elevator shaft. The machine used in the elevators according to these specifications is compact in at least one direction, but in other directions it may be much larger than conventional elevator machines.

In these basically good elevator solutions, the space and placement of the hoisting function limits the freedom of choice in elevator lay-out solutions. The arrangements for the passage of the hoisting ropes require space. The space required by the elevator car itself on its track, and likewise the space needed for the counterweight, can not be easily reduced, at least at a reasonable cost and without compromising on the performance and quality of operation of the elevator. In a traction sheave elevator without machine room, installing the hoisting machine in the elevator shaft, especially in the case of solutions with machine above, is often difficult because the hoisting machine is a fairly heavy and large object. Especially in the case of elevators for larger loads, speeds and/or hoisting heights, the size and weight of the machine are a problem in respect of installation, even so much so that the required machine size and weight have in practice limited the scope of application of the concept of elevator without machine room, or at least retarded the introduction of said concept in larger elevators. The space available in the elevator shaft in elevator modernization projects has often limited the scope of application of the concept of elevator without machine room. Often, especially in the cases of modernization or replacement of hydraulic elevators, it has not been practical to apply a roped elevator solution without machine room, due to insufficient space in the elevator shaft especially in a situation where no counterweight has been used in the hydraulic elevator solution to be modernized/replaced. The drawbacks of elevators provided with a counterweight include the cost of the counterweight and the space required for the counterweight in the elevator shaft. Drum-driven elevators, which at present are quite seldom installed, have the disadvantages of heavy and complicated hoisting machines and their high power and/or torque requirements. Prior-art elevator solutions without counterweight are exotic and no appropriate solutions are known. So far, it has not been technically or economically reasonable to make elevators without counterweight. One solution like this is disclosed in specification WO9806655. The recent international patent application PCT/FI03/00818 discloses a feasible elevator solution without counterweight that differs from prior-art solutions. In prior-art elevator solutions without counterweight, the tensioning of the hoisting rope is implemented using a weight or spring, and that is not an attractive approach to implementing the tensioning of the hoisting rope. Another problem with elevators without counterweight, when long ropes are used e.g. due to a large hoisting height or large suspension ratios used, is the compensation of rope elongations and at the same time, due to rope elongations, the friction between the traction sheave and the hoisting ropes is insufficient for the operation of the elevator. In the case of a hydraulic elevator, especially a hydraulic elevator with lifting power applied from below, the shaft efficiency, i.e. the ratio of the cross-sectional shaft area taken up by the elevator car to the total cross-sectional area of the elevator shaft, is fairly high. This has traditionally been a significant reason why expressly a hydraulic elevator has been selected for a building. On the other hand, hydraulic elevators have many drawbacks related to their lifting principle and use of oil. Hydraulic elevators have a high energy consumption, a possible oil leakage from the equipment is an environmental hazard, the periodically required oil change involves a high cost, even an elevator installation in good condition causes olfactory disadvantages as small amounts of oil escape into the elevator shaft or machine room and from there further to other parts of the building and into the environment and so on. Due to the shaft efficiency of a hydraulic elevator, modernization of the elevator by replacing it with another type of elevator that would allow the drawbacks of the hydraulic elevator to be avoided but would necessitate the use of a smaller elevator car is not an attractive solution to the owner of the elevator. Hydraulic elevators also have small machine spaces, which may be located at a distance from the elevator shaft, making it difficult to change the elevator type.

There are very large numbers of traction sheave elevators installed and in use. They were made at their time to meet the proposed needs of users and the intended uses of the buildings concerned. Later, both user needs and the practical requirements of the buildings have changed in many cases and an old traction sheave elevator may have become insufficient in respect of size of the elevator car or in other respects. For example, older elevators of a rather small size are not necessarily suited for transporting perambulators or roller chairs. On the other hand, in older buildings that have been converted from residential use to office or other use, the originally installed smaller elevator is no longer sufficient in capacity. As is known, increasing the size of such a traction sheave elevator is practically impossible because the elevator car and counterweight already fill the cross-sectional area of the elevator shaft and the car can not be reasonably enlarged.

SUMMARY

The general aim of the invention is to achieve at least one the following objectives. An objective of the invention is to develop the elevator without machine room so as to achieve more efficient space utilization in the building and in the elevator shaft than before. This means that the elevator should permit of being installed in a relatively narrow elevator shaft if necessary. One objective is to achieve an elevator in which the elevator hoisting rope has a good hold/grip on the traction sheave. A further objective of the invention is to create an elevator solution without counterweight without compromising on the properties of the elevator. It is also an objective to eliminate the undesirable effects of rope elongations. An additional objective of the invention is to achieve a more efficient utilization of the elevator shaft spaces above and below the elevator car than before in the case of elevators without counterweight. A specific objective is to create an effective method of installing a traction sheave elevator without counterweight in an elevator shaft. A further objective is to reduce the amount of work and time required in the actual installation process.

The objective or objectives of the invention should be achieved without compromising on the possibility of varying the basic layout of the elevator.

The method of the invention is discussed below. The delivery assembly of the invention is also discussed below. Some embodiments of the invention are characterized by what is disclosed in the claims. Inventive embodiments are also presented in the description part of the present application. The inventive content disclosed in the application can also be defined in other ways than is done in the claims below. The inventive content may also consist of several separate inventions, especially if the invention is considered in the light of explicit or implicit sub-tasks or in respect of advantages or sets of advantages achieved. The features of different embodiments and applications of the invention may also be combined in other ways besides those described here. Some of the attributes contained in the claims below may be superfluous from the point of view of separate inventive concepts. By applying the invention, one or more of the following advantages, among others, can be achieved:

- the invention enables a simple manner of installing an elevator while also reducing the installation time; the installation time is shortened and the total installation costs are reduced
- the rigging of the elevator, i.e. the mounting of the hoisting ropes on the rope pulleys of the elevator can be at least partially carried out beforehand, allowing a saving in the amount of work needed during actual elevator installation. Making the elevator from pre-assembled modules likewise accelerates installation and prevents installation errors. This makes it possible to achieve cost savings because in the factory environment many work stages can be carried out more easily, faster and otherwise in a more cost-effective manner than at the site of installation.
- so-called "one-man installation" becomes possible for a significant portion of the installation time or even for the entire installation work, so the progress of the installation work is not retarded by waiting times incurred when several persons are working together; a saving on installation time of up to one third can be achieved; work safety is improved as the working time in the shaft is reduced
- as the diverting pulleys for the upper part of the shaft and the machine are mounted on the guide rails, no separate steel structures reducing the shaft space above the elevator car need to be provided at the upper end of the elevator shaft
- by applying the invention, effective utilization of the cross-sectional area of the shaft is achieved
- installation in the shaft is easy because a module comprising car structures, e.g. the car frame and/or car ceiling and/or car floor, as well as the rope pulleys for the upper part of the shaft, the rope pulleys for the lower part of the shaft and the rope pulleys of the elevator car, preferably also the hoisting machine, the rigging made beforehand on the rope pulleys and the rope reels containing the tail ends of the ropes of the rigging and comprised in the module can be brought into the shaft via a shaft door opening by using a pump hoist truck or equivalent or via the shaft ceiling by means of a hoist
- installation can be carried out correctly, and by using fairly large installation modules the risk of parts being lost from the delivery assembly is significantly reduced
- although the invention is primarily intended for use in elevators without machine room, it can also be applied for use in elevators with machine room, in which case the hoisting ropes have to be passed separately via the hoisting machine in the machine room or the traction sheave of the hoisting machine has to be arranged to be mounted in the elevator shaft
- Preferable suspension ratios above and below the elevator car are 2:1, 6:1, 10:1 and so on. Other suspension ratios may also be used, e.g. 8:1 or other even ratios. In rope suspension, if the end of the hoisting ropes is attached to the elevator car, the suspension ratio may be an odd ratio, e.g. 7:1 or 9:1.
- Symmetrical suspension of the elevator car relative to the elevator car is easily achieved at least in the preferred embodiments of the invention.

The primary area of application of the invention is elevators designed for transporting people and/or freight. A normal area of application of the invention is in elevators whose speed range is about or below 1.0 m/s but may also be higher. For example, an elevator traveling at a speed of 0.6 m/s is easy to implement according to the invention.

In the elevator of the invention, normal elevator ropes, such as generally used steel wire ropes, are applicable. The elevator may use ropes of synthetic material and rope structures with a synthetic-fiber load-bearing part, such as e.g. so-called "aramid" ropes, which have recently been proposed for use in elevators. Applicable solutions are also steel-reinforced flat belts, especially because of the small deflection radius they permit. Particularly advantageously applicable for use in the elevator of the invention are elevator hoisting ropes twisted from e.g. round and strong wires. In this way it is possible to achieve thinner ropes and, due to the smaller rope thicknesses, also smaller diverting pulleys and drive sheaves. Using round wires, the rope can be twisted in many ways using wires of the same or different thicknesses. In ropes well applicable with the invention, the wire thickness is below 0.4 mm on an average. Well-suited ropes made from strong wires are those in which the average wire thickness is under 0.3 mm or even under 0.2 mm. Ropes especially well applicable in the invention are thin ropes having a thickness below 8 mm, preferably between 3 mm . . . 6 mm, e.g. 4 mm or 5 mm, made from wires that are stronger than the wires in the most strong-wired ropes conventionally used in elevators at present, i.e. the wire strength is greater than 1770 N/mm$^2$. The advantages of thin and strong wires already become apparent when the rope wires have a strength of about 2000 N/mm$^2$ or more, in which case the load-bearing capacity of the set of hoisting ropes can be achieved with a reasonable number of parallel hoisting ropes and the width of the set of hoisting ropes remains reasonable. Appropriate rope wire strengths are 2100-2700 N/mm$^2$. In principle, it is possible to use rope wires of a strength of about 3000 N/mm$^2$ or even more. In practice, a rope having a wire strength of about 2100 N/mm$^2$ is chosen rather than a rope in which the wire strength is very much greater, e.g. 3000 N/mm$^2$, because a stronger wire is generally also more expensive and its quality can not necessarily be as easily standardized as the quality of a less strong rope. A significant factor here is whether a sufficient load-bearing capacity of the roping in relation to the width of set or ropes is achieved.

By increasing the contact angle using a rope pulley that functions as a diverting pulley, the grip between the traction sheave and the hoisting ropes can be improved. A contact angle of over 180° between the traction sheave and the hoisting rope is achieved by using a diverting pulley or diverting pulleys. In this way, the weight as well as the size of the car can be reduced, thus increasing the space-saving potential of the elevator.

The elevator applying the invention is preferably an elevator without counterweight and with an elevator car guided by guide rails and suspended by means of diverting pulleys on a set of hoisting ropes in such manner that that the set of hoisting ropes of the elevator comprises rope portions going upwards and downwards from the elevator car. The elevator comprises a number of diverting pulleys in the upper and lower parts of the elevator shaft. In the elevator shaft, the elevator has a drive machine provided with a traction sheave. The elevator has a compensating device acting on the hoisting ropes to equalize and/or compensate the rope tension and/or rope elongation. The diverting pulleys are preferably mounted on the elevator car near its two side walls.

According to the invention, delivery and installation of the elevator may proceed as follows:

1. The elevator is brought to the site of installation in the form of pre-assembled modules, so the actual installation work can be carried out easily and quickly.
2. A rope for a hoist is mounted in the elevator shaft e.g. by fastening to the ceiling a pulley block to which the rope is passed, and a hoisting device suited for the installation work is introduced to drive the rope.
3. An overspeed governor—safety gear system is installed in the shaft so that the elevator car to be installed or a part of it that is going to be used in the installation work can be protected against uncontrolled movement already during installation time.
4. Plumb lines, laser sources, preferably two, or similar devices to be used for checking the straightness of the shaft and in the installation and alignment of the car guide rails are mounted in the shaft.
5. The lowest car guide rail sections are installed and aligned in position.
6. On the first installed guide rail sections are placed the car on buffers, a frame supporting the car and also functioning as a safety gear frame, or in the case of a self-supporting car at least a beam or beams to which the diverting pulleys placed on the car are to be mounted. This car frame or other part of the car mounted on the guide rails is used to mount the diverting pulleys on the car and it also carries by means of temporary support blocks or by other means the diverting pulleys to be installed at the upper end of the elevator shaft and the diverting pulleys to be installed at the lower end of the elevator shaft and preferably also the elevator hoisting machine and the traction sheave, and the hoisting ropes rigged with hoisting ropes arranged over at least some of the diverting pulleys, preferably over all the diverting pulleys and the traction sheave. At this stage of the in installation work, the remaining parts of the hoisting ropes are on reels placed on the car frame or other structure supporting the car.
7. Using the hoist, a hoisting operation is performed by hoisting by the upper part of the car frame or by the beam structure at the upper part of the car so that the preferably telescopically constructed car frame is stretched/the top beam of the car comes to a sufficient height, preferably to a height corresponding in respect of construction of the car to the final car height from the structure of the lower part of the car/car frame to allow the car to be constructed. The beam of the upper part of the car frame/car is firmly secured to the lower part of the car frame/car, using a fastening arrangement either final or temporary in respect of installation of the elevator. In the case of a car frame, it is preferable to lock the telescoping car frame to its final height at this stage, whereas in the case of a self-supporting car the top beam of the car and a working surface in the lower part of the car, e.g. the car floor can be fastened together by the car walls or by other means, e.g. with temporary beams or tension bars. The car floor is preferably installed at this stage, both in the case of a car with a car frame and in the case of a self-supporting car construction. To the structure thus obtained are fastened boxes or holders on which the car guide rails are carried along. In an installation with a car frame, conventional rubber insulators or other suitable vibration insulating elements are placed between the car floor and the car frame.
8. The car walls are installed, preferably starting with the back wall. The walls and the floor preferably constitute in themselves a structure relatively rigid against torsion, but if necessary the structure can be stiffened by means of separate reinforcing elements.
9. The ceiling of the car is mounted in place, preferably by a final arrangement, thus making the car itself quite stiff, so it will be well able to withstand all the stress it is subjected to during installation and subsequent operation.
10. The overspeed governor—safety gear system is activated in its function of controlling the motion of the car.
11. An installation-time safety device acting on the safety gear or other means locking the elevator car to the guide rails is added to the elevator. The installation-time safety device may be automatic, such that whenever the rope of the hoist used to lift the elevator car becomes loose or the force supporting the elevator car falls below a certain limit, the safety device causes the car to be immovably locked to the guide rail. The safety device may be a pedal or other coupling means that is used by the installer to keep the safety gear or other safety device in a state permitting movement of the elevator as he/she is driving the elevator by means of the hoist, and at other times the safety device automatically prevents movement of the elevator car.
12. In a preferable case, all the guide rails are loaded onto the car and the installation of the car guide rails is started by installing new guide rails above those already installed, using the elevator car as a working platform and raising the elevator upwards car by means of the hoist as the installation work is progressing.
13. The guide rails are aligned with the help of laser beams and/or other means conventionally used for the alignment of guide rails.
14. When the upper end of the shaft is reached, the diverting pulleys brought on the car for the upper part of the shaft are mounted in the upper part of the shaft, preferably on diverting pulley supporters secured to the upper part of the elevator guide rails. The drive machine of the elevator is also preferably mounted on a guide rail. The drive machine and at least one of the diverting pulleys may have a common supporter by which they are supported on the guide rail. If necessary, a suitable hoist or other hoisting tool is utilized.

15. After the pulleys in the upper part have been mounted in place and the rope ends secured if necessary, the elevator car is moved downwards while at the same time supplying more rope from the rope reels. The length of the rope portions between the car and the upper part of the shaft now increases correspondingly.
16. After the elevator car has descended to a suitable height in the lower part of the shaft, the diverting pulleys for the lower part of the shaft are released from their temporary fastening and mounted in the lower part of the elevator car. In this way, the hoisting ropes have been supplied from the rope reels and have reached their final length.
17. The equipment equalizing rope forces and compensating rope elongations is installed so that it will act on the ropes unless this has been done beforehand, and the ends of the ropes in the set of ropes are secured to the positions determined by the roping diagram.

The installation work will not necessarily follow the above-described procedure in all the various stages of installation and/or not all the stages of installation are necessary, at least quite in the form described above. For example, only some of the rope pulleys in the installation may have been rigged beforehand, in which case the rest of the rope pulleys have to be rigged in conjunction with installation. When a new elevator is installed in place of an old one but the old guide rails are used, the installation of guide rails would be left out completely from the stages of the method.

In simplified terms it could be stated that, when an elevator without counterweight is to be installed, the main components of the elevator are at first installed on the bottom of the shaft between the first guide rails, in which case the two first guide rail sections, typically of a length of a few meters, preferably equal to about one floor-to-floor height or distance. Often the guide rails are delivered in sections of a length of about five meters, which are then joined together during installation to form a guide rail line extending from the lower part of the elevator shaft to its upper part. In less spacious environments shorter guide rail sections of a length of about 2½ meters are easier to handle. Between the first guide rails is assembled a car supporting frame, a safety gear frame, an elevator car or equivalent, which is used as an "installation tool" and/or as an installation carriage, to which are secured in a temporary manner the diverting pulleys of the car as well as the hoisting machine together with the associated equipment. After the installation of the guide rails, the ropes rigged beforehand on the rope pulleys are "stretched" to their final length by moving the car supporting frame/car downwards after the diverting pulleys in the upper part of the shaft and the machine have first been mounted in place. Finally, the diverting pulleys in the lower part of the elevator shaft are mounted in place.

BRIEF DESCRIPTION OF THE DRAWINGS

In the following, the invention will be described in detail with reference to a few embodiment examples and the attached drawings, wherein.

DETAILED DESCRIPTION OF EXAMPLE EMBODIMENTS

Figure 1:
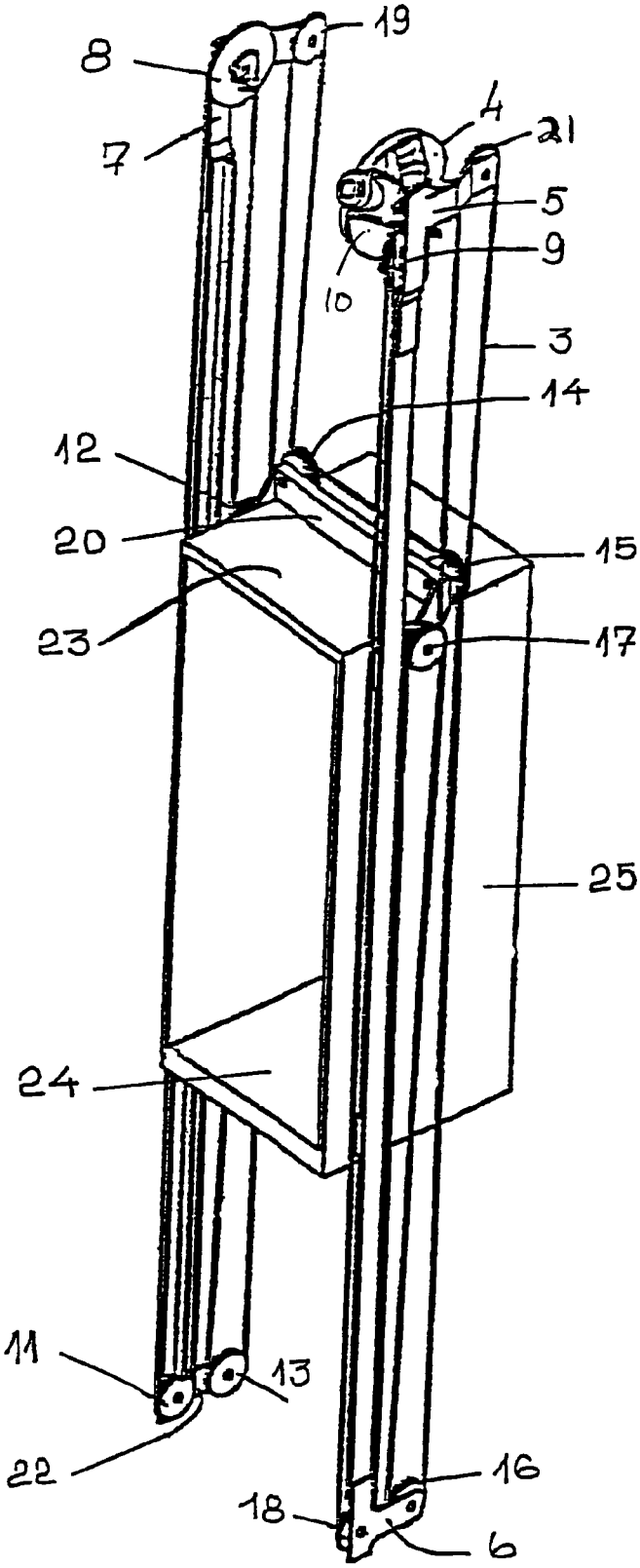
FIG. 1 is a diagram representing an elevator achieved by the invention.
Figure 2:
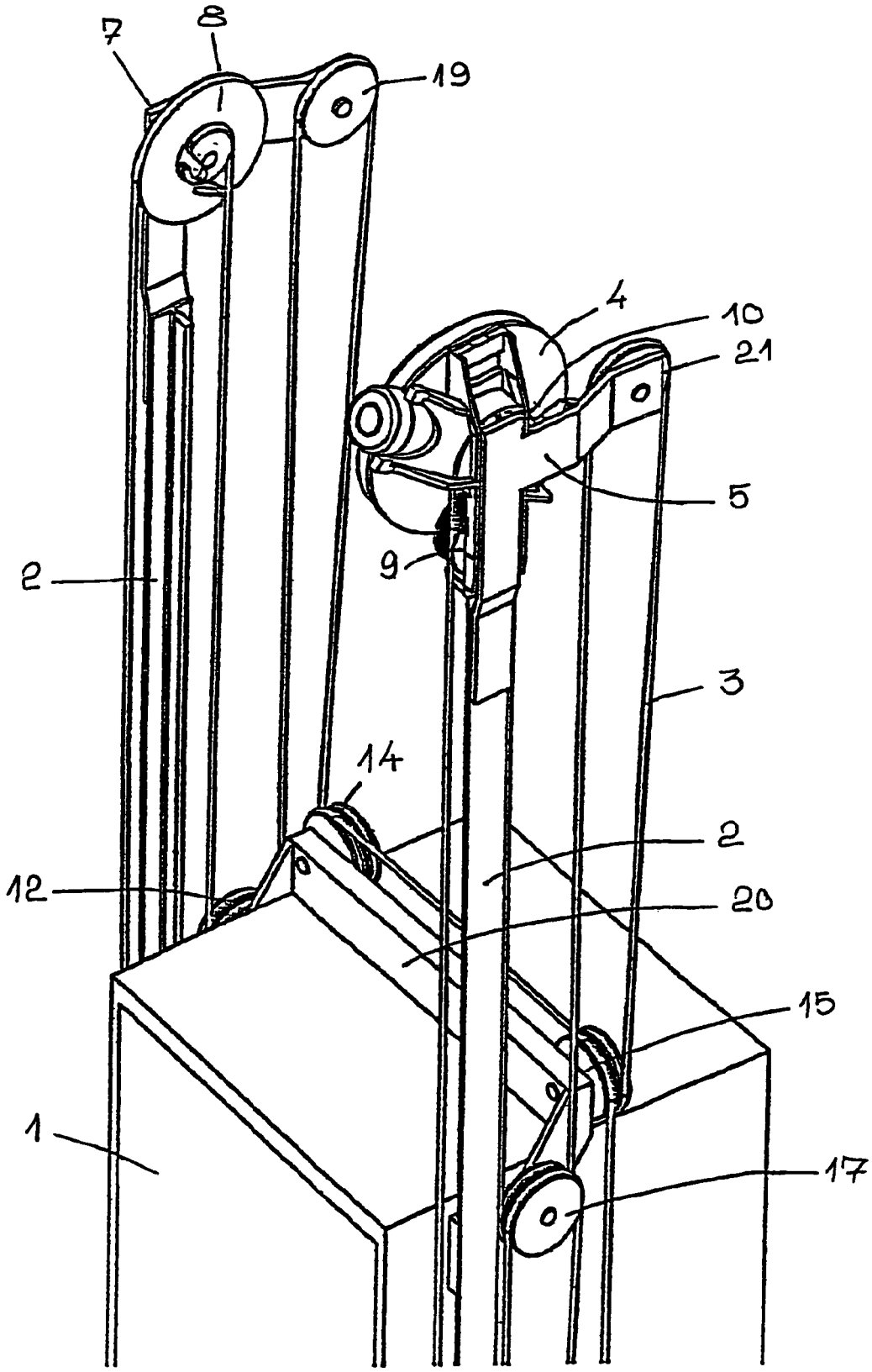
FIG. 2 is a diagram representing the elevator in FIG. 1 as seen from another angle.
Figure 3:
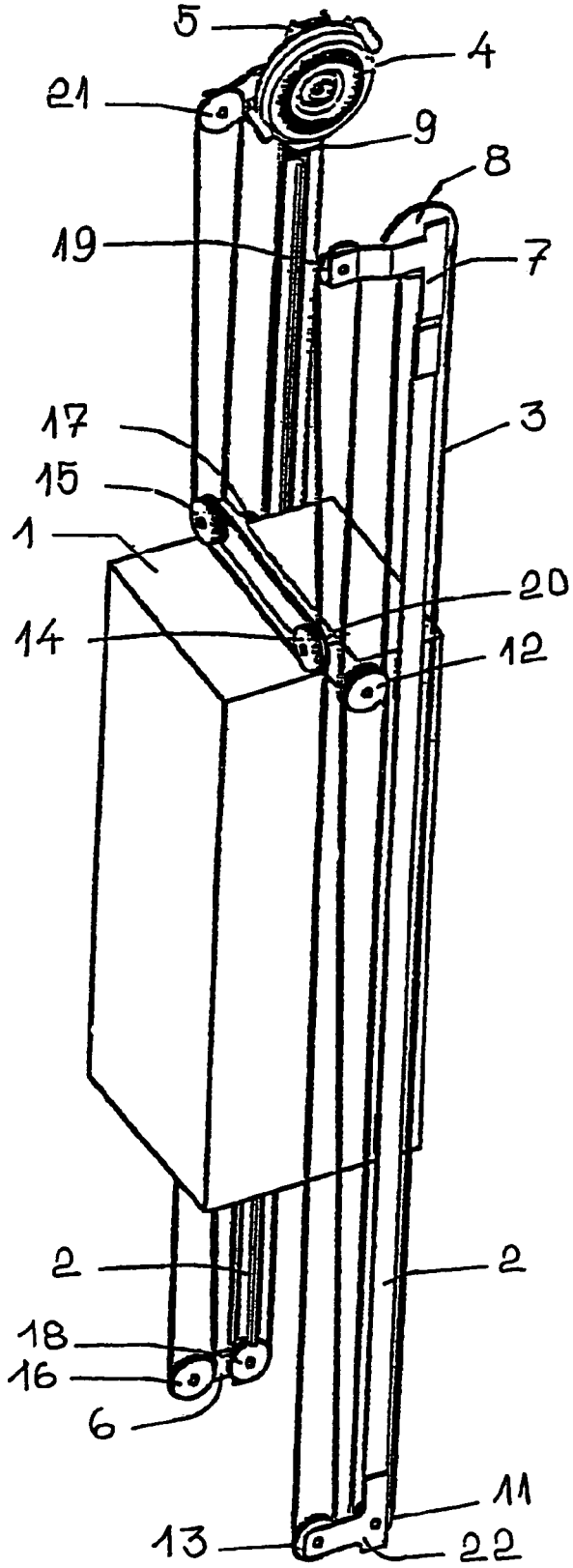
FIG. 3 is a diagram representing the elevator in FIG. 1 and 2 as seen from a third angle.

FIGS. 1, 2 and 3 are diagrams illustrating the structure of an elevator achieved by the invention. The elevator is preferably an elevator without machine room and with a drive machine 4 placed in the elevator shaft. The elevator presented in the figures is a traction sheave elevator without counterweight and with machine above, in which the elevator car 1 moves along guide rails 2. In FIGS. 1, 2 and 3, the hoisting ropes run as follows: one end of the hoisting ropes is fixed to a wheel of a smaller diameter comprised in a compensating gear functioning as a compensating device 8, said wheel being fixedly attached to a second wheel of a larger diameter comprised in the compensating gear 8. This compensating gear 8 functioning as a compensating device has been fitted to be fastened to the elevator shaft via a supporting element 7 immovably fixed to an elevator guide rail 2. The compensating gear serves to adjust the difference of rope tension between the rope portions above and below the elevator car, or rather the ratio between the rope tensions. From the wheel of smaller diameter comprised in the compensating gear 8, the hoisting ropes 3 go downwards to a diverting pulley 12 mounted on the elevator car, preferably on a beam 20 fitted in place in the upper part of the elevator car, and pass around the diverting pulley 12 along rope grooves provided in it. In the rope wheels used as diverting pulleys, these rope grooves may be coated or uncoated, e.g. with a friction-increasing material, such as polyurethane or some other appropriate material. From diverting pulley 12, the ropes go further upwards to a diverting pulley 19 in the elevator shaft, said pulley being mounted in place on the supporting element 7, via which the diverting pulley 19 is mounted in place on the elevator guide rail. Having passed around diverting pulley 19, the ropes go further downwards to a diverting pulley 14 which has also been fitted in place on the beam 20 fitted in place on the elevator car, preferably in the upper part of the elevator car. Having passed around diverting pulley 14, the rope goes further transversely relative to the elevator shaft and elevator car to a diverting pulley 15 mounted in place on the same beam 20 on the other side of the elevator car, and after passing around this diverting pulley the hoisting ropes go further upwards to a diverting pulley 21 mounted in place in the upper part of the elevator shaft. Diverting pulley 21 has been fitted in place on a supporting element 5. Via the supporting element 5, the diverting pulley is supported by the elevator guide rails 2. Having passed around diverting pulley 21 , the hoisting ropes go further downwards to a diverting pulley 17 mounted on the elevator car 1 and also fitted in place on the beam 20. Having passed around diverting pulley 17, the hoisting ropes go further upwards to a diverting pulley 9 preferably mounted in place near the hoisting machine 4. Between diverting pulley 9 and the traction sheave 10, the figure shows Double Wrap (DW) roping. From diverting pulley 9, the hoisting ropes go further to the traction sheave 10 after first passing via diverting pulley 9 in "tangential contact" with it. This means that the ropes 3 going from the traction sheave 10 to the elevator car 1 pass via the rope grooves of diverting pulley 9 and the deflection of the rope 3 caused by the diverting pulley 9 is very small. It could be stated that the ropes 3 going from the traction sheave 10 only come into "tangential contact" with the diverting pulley 9. Such "tangential contact" functions as a solution for damping rope vibrations and it can also be applied in other roping solutions. The ropes pass over the traction sheave 10 of the hoisting machine 4 along the rope grooves on the traction sheave 10. From the traction sheave 10, the ropes 3 go further downwards to diverting pulley 9, passing around it along the rope grooves of the diverting pulley 9 and returning back up to the traction sheave 10, over which the ropes pass along the rope grooves of the traction sheave. From the traction sheave 10, the ropes 3 go further downwards in "tangential contact" with diverting pulley 9 past the elevator car 1 moving along the guide rails 2 to a diverting pulley 18 placed in the lower part of the elevator shaft. The hoisting machine and diverting pulley 9 are mounted in place on the supporting element 5, which in turn is fixed in place on the elevator guide rails 2. Diverting pulleys 12, 19, 14, 15, 21 17, 9 and the wheel of smaller diameter comprised in the compensating gear 8 together with the traction sheave 10 of the hoisting machine 4 form the suspension above the elevator car, which has the same suspension ratio as the suspension below the elevator car, which suspension ratio in FIG. 1, 2 and 3 is 6:1. The hoisting ropes pass around diverting pulley 18 along rope grooves provided on it, which has been fitted in place preferably in the lower part of the elevator shaft on a supporting element 6 fixed in place to an elevator guide rail 2. Having passed around diverting pulley 18, the ropes 3 go further upwards to diverting pulley 17 fitted in place on the elevator car and mounted on the beam 20, and having passed around said diverting pulley 17, the ropes go further downwards to a diverting pulley 16 in the lower part of the elevator shaft, which has been mounted in place on supporting element 6. Having passed around diverting pulley 16, the ropes return to diverting pulley 15 fitted in place on the elevator car, said pulley being mounted on the beam 20. From diverting pulley 15, the hoisting ropes 3 go further transversely across the elevator car to the diverting pulley 14 mounted in place on the beam 20 on the other side of the elevator car. Having passed around this diverting pulley, the ropes go further downwards to a diverting pulley 13 fitted in place in the lower part of the elevator shaft, said pulley being mounted in place on a supporting element 22, which supporting element 22 in turn has been fixed in place to the elevator guide rail 2. Having passed around diverting pulley 13, the ropes go further upwards to diverting pulley 12 fitted in place on the elevator car, said pulley being mounted on the beam 20. Having passed around diverting pulley 12, the ropes 3 go further downwards to a diverting pulley 11 mounted in place on a supporting element 22 in the lower part of the elevator shaft. Having passed around diverting pulley 11, the hoisting ropes 3 go further upwards to the compensating gear 8 mounted in place in the upper part of the shaft, the second end of the hoisting rope being fixed to the wheel of larger diameter comprised in compensating gear 8. The compensating gear functioning as a compensating device 8 is mounted in place on supporting element 7. Diverting pulleys 18, 17, 16, 15, 14, 13, 12 , 11 and the wheel of larger diameter in the compensating gear 8 functioning as a compensating device form the suspension below the elevator car, which has the same suspension ratio as the suspension above the elevator car, this suspension ratio being 6:1 in FIG. 1, 2 and 3.

In FIG. 1, 2 and 3, the compensating gear 8 consists of two wheel-like components, preferably wheels, of different diameters and immovably fixed to each other, which compensating gear 8 has been fitted in place on supporting element 7, which again is mounted in place on the elevator guide rails 2. Of the wheel-like components of the compensating gear 8, the wheel connected to the hoisting rope portion below the elevator car has a larger diameter than the wheel connected to the hoisting rope portion above the elevator car. The diameter ratio between the diameters of the wheels of the compensating gear defines the magnitude of the tensioning force acting on the hoisting rope and therefore also the force of compensation of the elongations of the hoisting rope and at the same time the magnitude of the rope elongation to be compensated. The use of a compensating gear 8 provides the advantage that this structure will compensate even very large rope elongations. By varying the size of the diameters of the wheels of the compensating gear 8, it is possible to influence the magnitude of the rope elongation to be compensated and the ratio between the rope forces $T_1$ and $T_2$ acting over the traction sheave, which ratio can be made constant by the arrangement in question. Due to a large suspension ratio or a large hoisting height, the length of the rope used in the elevator is large. Therefore, it is essential for the operation and safety of the elevator that the hoisting rope portion below the elevator car is held under a sufficient tension and that the amount of rope elongation to be compensated is large. Often this can not be implemented using a spring or a simple lever. In the case of odd suspension ratios above and below the elevator car, the compensating gear functioning as a compensating device in the elevator depicted in FIG. 1, 2 and 3 is fitted in place on the elevator car by means of a transfer gear, and in the case of even suspension ratios the compensating gear functioning as a compensating device in the elevator of the invention is fitted in place in the elevator shaft, preferably on the elevator guide rails. In the compensating gear 8 of the invention it is possible to use wheels, the number of which is two, but the number of wheel-like components used may vary, for example it is possible to use only one wheel with hoisting rope fixing points fitted on it at different positions along the diameter. It is also possible to use more than two wheels if it is desirable e.g. to vary the ratio between the diameters of the wheels by only changing the diameters of the wheels in the compensating gear. The elevator without counterweight presented in FIG. 1, 2 and 3 is not provided with traditional springs for compensating the rope forces, but instead it uses a compensating gear 8 as a compensating device. Consequently, the ropes comprised in the set of hoisting ropes 3 can be secured directly to the compensating gear 8. Besides a compensating gear as presented in the figures, the compensating device of the invention may also consist of a suitable lever or other appropriate compensating device with several compensating wheels. The beam 20 presented in the figures which is fixed in place in conjunction with the elevator car may also be mounted elsewhere than in the place above the elevator car as shown in the figures. It may also be placed e.g. below the elevator car or somewhere between these positions. The diverting pulleys may have a plurality of grooves and the same diverting pulley can be used to guide both the passage of the hoisting ropes comprised in the suspension above the elevator car and the passage of the hoisting ropes comprised in the suspension below the elevator car, as illustrated e.g. in the figures in connection with diverting pulleys 12,14,15,17.

A preferred embodiment of the elevator of the invention is an elevator without counterweight and with machine above, which elevator has a drive machine with a coated traction sheave and thin hoisting ropes of a substantially round cross-section. The contact angle of the hoisting ropes on the traction sheave of the elevator is greater than 180°. The elevator comprises a unit comprising the drive machine, the traction sheave and a diverting pulley, all fitted in place via a supporting element, the diverting pulley being ready fitted in a correct angle relative to the traction sheave. This unit is secured to the elevator guide rails. The elevator is implemented without counterweight with a suspension ratio of 6:1. The compensation of rope forces and elongations is implemented using a compensating device according to the invention. The diverting pulleys in the elevator shaft are fitted in place by means of supporting elements on the elevator guide rails and the diverting pulleys on the elevator car are all mounted in place on a beam on the elevator car, said beam also forming a structure bracing the elevator car.

The elevator car 1 is suspended on the hoisting ropes via the beam 20 and the diverting pulleys mounted on the beam. The beam 20 is part of the load-bearing structure of the elevator car, which may be in the form of a self-supporting car or a framework of beams or the like joined or integrated to the elevator car. The elevator is preferably installed by starting the actual installation in the shaft by bringing in the elevator car or a car module comprising car components, which contains the diverting pulleys of the car ready assembled and, secured to it in a temporary manner, the diverting pulleys for the upper part of the shaft, the diverting pulley for the lower part of the shaft, the rope compensating device and the elevator hoisting machine, and in conjunction with which the elevator ropes have been rigged beforehand, and on which an amount of hoisting rope required for the operation of the elevator is carried along, the rope length exceeding the roping beforehand being carried along with the car/module, on reels possibly secured to the car structures. The floor 24 of the elevator car 1 can be initially placed as a working platform or a separate working platform can be used for the installation of the ropes. As the hoisting ropes have been mounted beforehand on the diverting pulleys, the diverting pulleys of the upper and lower parts of the elevator shaft and those of the elevator car can be moved further away from each other while at the same time supplying more rope into the elongating rigging. The diverting pulleys in the upper part of the elevator shaft are mounted in place by utilizing the elevator car or in some other way. The diverting pulleys of the elevator car are raised together with the beam 20 to a distance from the floor 24 of the elevator car and the elevator car 1 is assembled by joining the walls 25 to the floor and mounting the beam 20 and ceiling 23 in the upper part of the elevator car.

Figure 4:
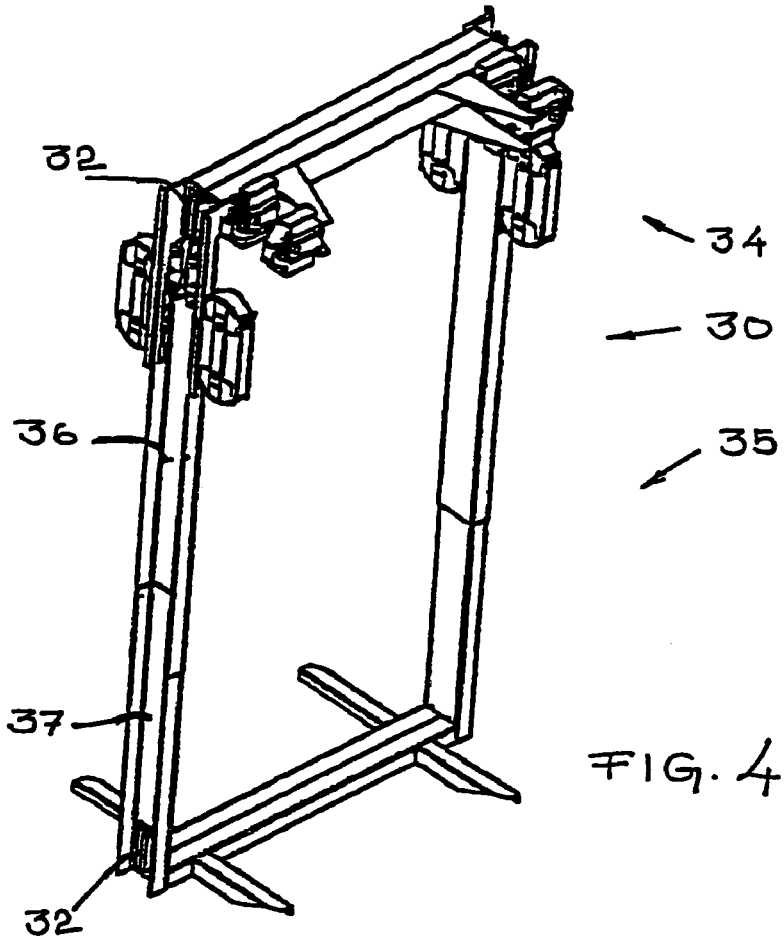
FIG. 4 presents a car supporting frame according to the invention, extended to a height at which the car can be installed in the frame.
Figure 5:
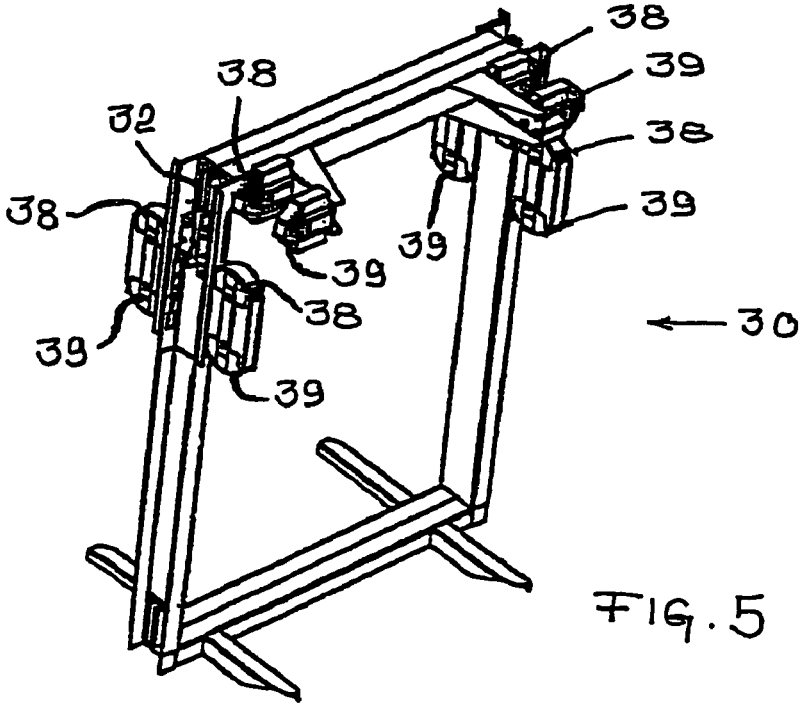
FIG. 5 presents the car supporting frame of the invention in a collapsed form.
Figure 6:
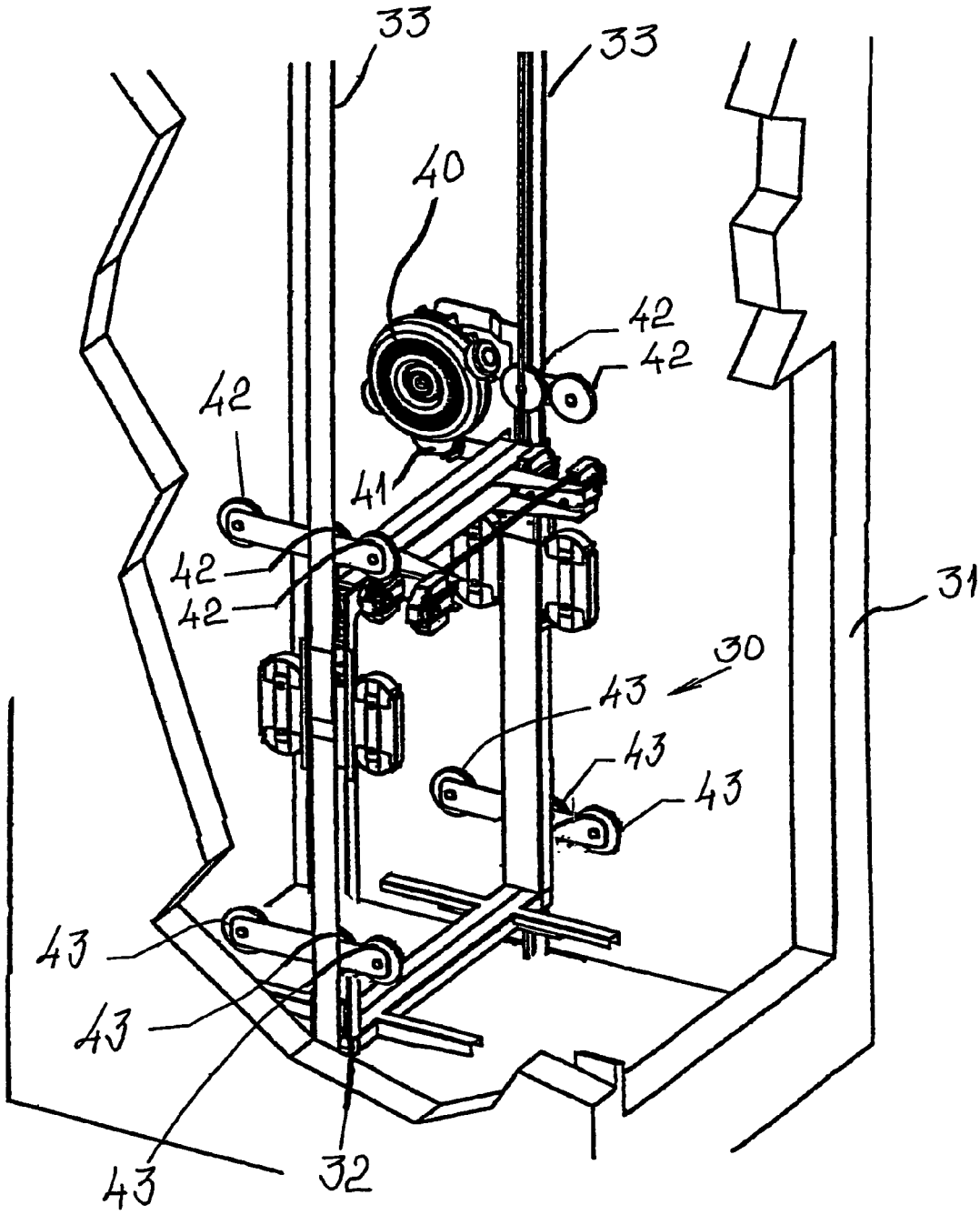
FIG. 6 presents the car supporting frame of the invention on the bottom of the shaft.
Figure 7:
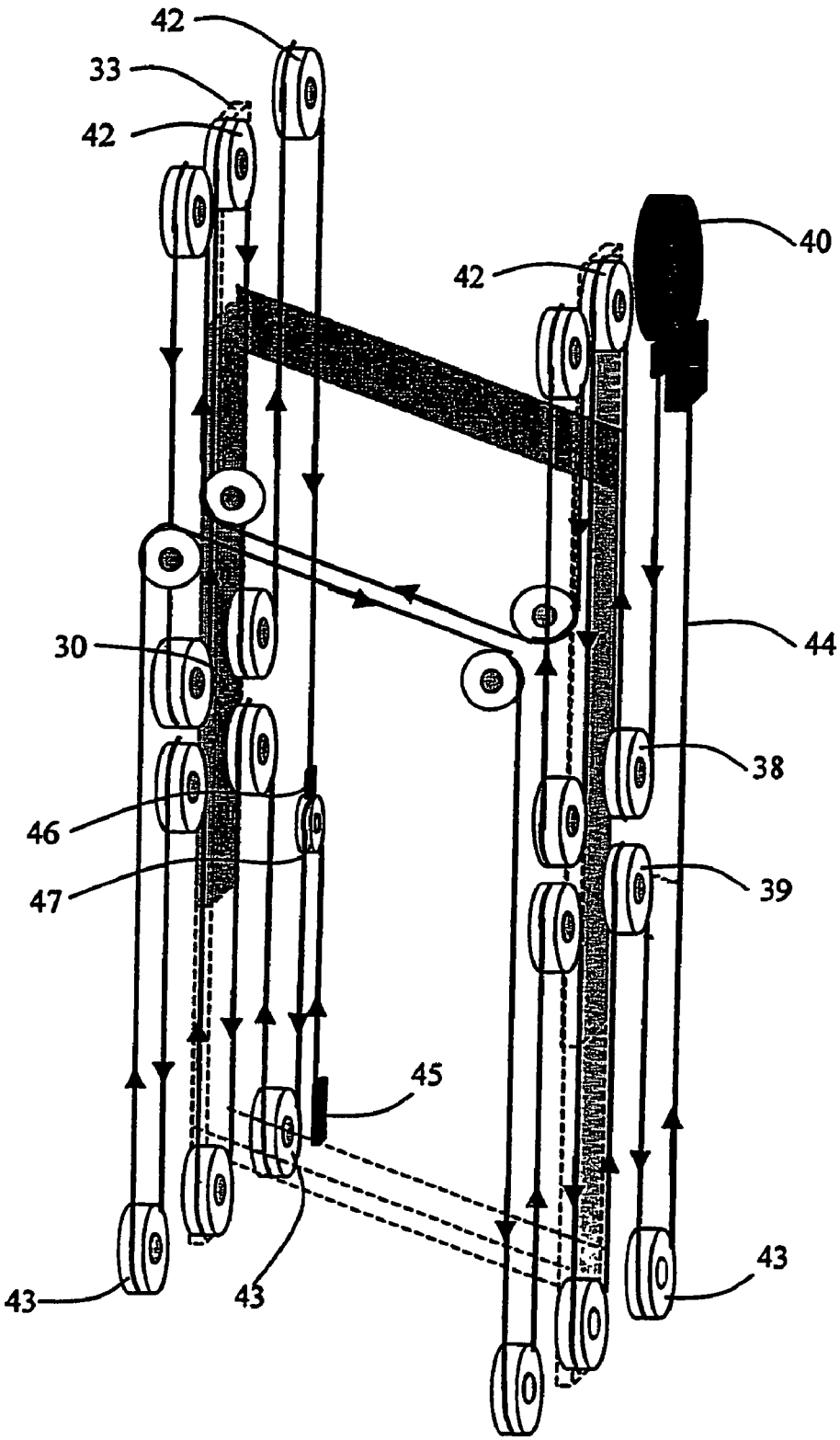
FIG. 7 is a diagrammatic representation of rope rigging implemented according to the invention.

FIG. 7 illustrates how the ropes of an elevator implemented according to the invention are passed over different diverting pulleys and rope pulleys of the hoisting machine, and FIG. 4, 5 and 6 show the car supporting frame 30, which in FIG. 4 is presented in a length in which the car can be installed inside the frame while FIG. 5 presents it in a collapsed or low form that makes the frame easy to transport, as far as the frame is transported as a complete assembly, with diverting pulleys mounted on it, allowing the ropes to be easily passed to them. FIG. 4 and 5 do not show the diverting pulleys of the upper and lower parts of the shaft. FIG. 6 presents the car supporting frame when it is on the bottom of the elevator shaft 31. The car supporting frame is provided with guides 32, by means of which the car is positioned and guided as it is moving vertically along the elevator guide rails 33. The upper part 34 and lower part 35 of the car supporting frame are telescopically joined together by beam sections 36 and 37 of the side beams of the car frame, which sections go inside each other. The telescopic or otherwise variable-length joining together of the upper and lower parts can also be implemented in other ways. The car supporting frame is provided with diverting pulleys intended for the suspension of the elevator car on the ropes, comprising a first set of diverting pulleys 38, from which the ropes of the set of hoisting ropes go upwards, and a second set of diverting pulleys 39, from which the ropes of the set of hoisting ropes go downwards. FIG. 6 shows the diverting pulleys 42 to be installed in the upper part of the shaft but which are temporarily mounted on the car supporting frame, the hoisting machine 40 with a traction sheave (not shown) and preferably an auxiliary diverting pulley 41, which allows the roping on the machine to be implemented as so-called Double Wrap roping or the contact angle between the traction sheave and the ropes to be changed in other ways, and the diverting pulleys 43 to be mounted in the lower part of the shaft. For the sake of clarity, the hoisting ropes rigged beforehand on the diverting pulleys are not shown in FIG. 6. The car frame preferably comprises other car components, such as the car floor, which can thus be used as a working platform. In conjunction with the car frame, the amount of hoisting rope required for the set of hoisting ropes to be stretched out to full length is brought on reels into the elevator shaft or to the vicinity of the elevator shaft. The reels are not shown in the figures. In FIG. 7, the set of hoisting ropes 44 is depicted as a single rope with arrowheads indicating the passage of the rope, starting from the rope end fixing point 45 in the lower part of the shaft and finally ending up at a rope force differentiating arrangement 46, which consists of a tackle system designed to maintain the relative rope tension difference between the rope portions above and below the elevator car. The rope force differentiating arrangement can also be implemented in other ways, which may involve a different solution regarding the fixing of the rope ends. Starting from the fixing point 45, the ropes go first to a rope wheel comprised in the differentiating arrangement 46, then continuing first to the diverting pulley 43 in the lower part of the shaft, from where the rope goes further to a down-direction diverting pulley 39 of the car and further, passing one by one over the diverting pulleys in the lower part of the shaft and the down-direction diverting pulleys of the car, until from the last diverting pulley in the lower part of the shaft the ropes go up to the machine 40. From the machine 40, the ropes run further to the first up-direction diverting pulley 38 on the car, passing by turns over the diverting pulleys 42 in the upper part of the shaft and each up-direction diverting pulley 38 until from the last diverting pulley in the upper part of the shaft the ropes terminate at the differentiating arrangement 46.

It is obvious to the person skilled in the art that different embodiments of the invention are not limited to the examples described above, but that they may be varied within the scope of the claims presented below. For example, the number of times the hoisting ropes are passed between the diverting pulleys in the upper part of the elevator shaft and those on the elevator car and between the diverting pulleys in the lower part of the elevator shaft and those on the elevator car is not a very decisive question as regards the basic advantages of the invention, although it is possible to achieve some additional advantages by using multiple and even numbers of rope portions. It is also obvious to the skilled person that an embodiment according to the invention can also be implemented using odd suspension ratios above and below the elevator car, in which case the compensating device is mounted in conjunction with the elevator car or its structures. In accordance with the examples described above, a skilled person can vary the embodiment of the invention as the traction sheaves and rope pulleys, instead of being coated metal pulleys, may also be uncoated metal pulleys or uncoated pulleys made of some other material suited to the purpose.

It is further obvious to the person skilled in the art that the metallic traction sheaves and rope wheels used as diverting pulleys in the invention, which are coated with a non-metallic material at least in the area of their grooves, may be implemented using a coating material consisting of e.g. rubber, polyurethane or some other material suited to the purpose.

It is also obvious to the person skilled in the art that the elevator car and the machine unit may be laid out in the cross-section of the elevator shaft in a manner differing from the lay-out described in the examples. The skilled person also understands that 'elevator car' may refer to a self-supporting car structure, an assembly consisting of an elevator car and a car supporting frame, or also a car structure mounted inside a car supporting frame.

It is obvious to the skilled person that an elevator applying the invention may be equipped differently from the examples described above. It is further obvious to the skilled person that the elevator of the invention can be implemented using as hoisting ropes almost any flexible hoisting means, e.g. a flexible rope of one or more strands, a flat belt, a cogged belt, a trapezoidal belt or some other type of belt suited to the purpose.

It is further obvious to the skilled person that the elevator of the invention may also be provided with a counterweight, in which case the counterweight of the elevator preferably has a weight below that of the car and is suspended by a separate set of ropes. The skilled person understands that an elevator shaft is not strictly necessary for the elevator, provided that sufficient safety and protection of the technical parts are achieved.

The invention claimed is:

1. A method for installing an elevator, the elevator to be installed including a structure comprising a number of assembled components of an elevator car of the elevator, a number of diverting pulleys adapted to mount in an upper part of an elevator shaft of the elevator, a number of diverting pulleys adapted to mount in a lower part of the elevator shaft, a plurality of upwards-directed diverting pulleys adapted to mount on the structure, a plurality of downwards-directed diverting pulleys adapted to mount on the structure, and a plurality of hoisting ropes, the method comprising:

delivering the plurality of hoisting ropes to a site of installation of the elevator as part of an assembly module that comprises the structure;

attaching to the structure at least some of the diverting pulleys adapted to mount in the upper part of the elevator shaft, at least some of the diverting pulleys adapted to mount in the lower part of the elevator shaft, and at least some of the diverting pulleys adapted to mount on the structure;

pre-rigging the at least some of the diverting pulleys adapted to mount in the upper part of the elevator shaft, the at least some of the diverting pulleys adapted to mount in the lower part of the elevator shaft, and the at least some of the diverting pulleys adapted to mount on the structure with the plurality of hoisting ropes;

bringing the structure and the pre-rigged diverting pulleys into the elevator shaft;

detaching from the structure the at least some of the diverting pulleys adapted to mount in the upper part of the elevator shaft and the at least some of the diverting pulleys adapted to mount in the lower part of the elevator shaft; and mounting the detached diverting pulleys in respective locations in the elevator shaft.

2. The method of claim 1, wherein the number of diverting pulleys adapted to mount in the upper part of the elevator shaft are hoisted to the upper part of the elevator shaft using the structure.

3. The method of claim 1, wherein a working platform is formed using the structure, and wherein by working from the platform, at least some of a plurality of elevator guide rails and the number of diverting pulleys adapted to mount in the upper part of the elevator shaft are mounted in place in the elevator shaft.

4. The method of claim 1, further comprising:

mounting lower sections of elevator car guide rails in the elevator shaft;

placing the structure in the elevator shaft so that the structure is guided by the lower sections of the elevator car guide rails;

partially or fully completing assembly of the elevator car;

raising the structure, the partially assembled elevator car, or the fully assembled elevator car in the elevator shaft using a hoist; and mounting remaining elevator car guide rails in the elevator shaft by working from a top of the structure, the partially assembled elevator car, or the fully assembled elevator car.

5. An elevator installed by the method of claim 1.

6. The method of claim 1, wherein the elevator is without a counterweight.

7. The method of claim 1, wherein the elevator to be installed includes a plurality of diverting pulleys adapted to mount in the upper part of the elevator shaft.

8. The method of claim 1, wherein the elevator to be installed includes a plurality of diverting pulleys adapted to mount in the lower part of the elevator shaft.

9. The method of claim 1, wherein the elevator to be installed further includes:

a compensating device.

10. The elevator of claim 5, wherein the elevator is without a counterweight.

11. The elevator of claim 5, wherein the elevator includes:

a compensating device.

12. An assembly module for an elevator, comprising:

a structure comprising a number of assembled components of an elevator car of the elevator;

a number of diverting pulleys adapted to mount in an upper part of an elevator shaft of the elevator;

a number of diverting pulleys adapted to mount in a lower part of the elevator shaft;

a plurality of upwards-directed diverting pulleys adapted to mount on the structure;

a plurality of downwards-directed diverting pulleys adapted to mount on the structure; and a plurality of hoisting ropes;

wherein at least some of the diverting pulleys adapted to mount in the upper part of the elevator shaft are attached to the structure, wherein at least some of the diverting pulleys adapted to mount in the lower part of the elevator shaft are attached to the structure, wherein at least some of the diverting pulleys adapted to mount on the structure are attached to the structure, and wherein the plurality of hoisting ropes is rigged via at least a number of the attached diverting pulleys.

13. The assembly module of claim 12, further comprising:

a hoisting machine;

wherein the hoisting machine is attached to the structure.

14. A method for installing an elevator, the elevator to be installed including a structure comprising a number of assembled components of an elevator car of the elevator, a plurality of diverting pulleys adapted to mount in an upper part of an elevator shaft, a plurality of diverting pulleys adapted to mount in a lower part of the elevator shaft, a plurality of upwards-directed diverting pulleys adapted to mount on the structure, a plurality of downwards-directed diverting pulleys adapted to mount on the structure, and a plurality of hoisting ropes, the method comprising:

delivering the plurality of hoisting ropes to a site of installation of the elevator as part of an assembly module that comprises the structure;

attaching to the structure at least some of the diverting pulleys adapted to mount in the upper part of the elevator shaft, at least some of the diverting pulleys adapted to mount in the lower part of the elevator shaft, and at least some of the diverting pulleys adapted to mount on the structure;

pre-rigging the at least some of the diverting pulleys adapted to mount in the upper part of the elevator shaft, the at least some of the diverting pulleys adapted to mount in the lower part of the elevator shaft, and the at least some of the diverting pulleys adapted to mount on the structure with the plurality of hoisting ropes;

bringing the structure and the pre-rigged diverting pulleys into the elevator shaft;

detaching from the structure the at least some of the diverting pulleys adapted to mount in the upper part of the elevator shaft and the at least some of the diverting pulleys adapted to mount in the lower part of the elevator shaft; and mounting the detached diverting pulleys in respective locations in the elevator shaft.

15. The method of claim 14, wherein the plurality of diverting pulleys adapted to mount in the upper part of the elevator shaft are hoisted to the upper part of the elevator shaft using the structure.

16. The method of claim 14, wherein a working platform is formed using the structure, and wherein by working from the platform, at least some of a plurality of elevator guide rails and the plurality of diverting pulleys adapted to mount in the upper part of the elevator shaft are mounted in place in the elevator shaft.

17. The method of claim 14, further comprising:

mounting lower sections of elevator car guide rails in the elevator shaft;

placing the structure in the elevator shaft so that the structure is guided by the lower sections of the elevator car guide rails;

partially or fully completing assembly of the elevator car;

raising the structure, the partially assembled elevator car, or the fully assembled elevator car in the elevator shaft using a hoist; and mounting remaining elevator car guide rails in the elevator shaft by working from a top of the structure, the partially assembled elevator car, or the fully assembled elevator car.

18. An elevator installed by the method of claim 14.

19. The method of claim 14, wherein the elevator is without a counterweight.

20. The method of claim 14, wherein the elevator to be installed further includes:

a compensating device.

* * * * *